United States Patent [19]

Aydin

[11] 4,177,657

[45] Dec. 11, 1979

[54] ELECTRONIC LOCK SYSTEM

[75] Inventor: Kemal Aydin, Little Falls, N.J.

[73] Assignee: Kadex, Inc., New York, N.Y.

[21] Appl. No.: 849,163

[22] Filed: Nov. 7, 1977

Related U.S. Application Data

[63] Continuation of Ser. No. 667,105, Apr. 16, 1976, abandoned.

[51] Int. Cl.[2] ..... E05B 49/02

[52] U.S. Cl. ..... 70/278; 70/219; 70/223

[58] Field of Search ..... 70/223, 222, 219, 218, 70/279, 278, 277; 361/172; 340/149 A

[56] References Cited

U.S. PATENT DOCUMENTS

| | | | |
|---|---|---|---|
| 1,005,496 | 10/1911 | Armbruster | 70/223 |
| 3,403,380 | 9/1968 | Welch | 70/278 |
| 3,475,932 | 11/1969 | Germanton | 70/278 |
| 3,641,396 | 2/1972 | Kossen et al. | 70/278 X |
| 3,673,569 | 6/1972 | Hedin et al. | 70/278 X |
| 3,751,718 | 8/1973 | Hanchett | 70/278 X |
| 3,797,936 | 3/1974 | Dimitriadis | 70/277 X |
| 3,845,362 | 10/1974 | Roe | 361/172 |
| 3,872,435 | 3/1975 | Cestaro | 361/172 X |
| 3,896,345 | 7/1975 | Zink | 361/172 |
| 3,922,896 | 12/1975 | Kagoura | 70/223 |
| 3,926,021 | 12/1975 | Genest et al. | 70/278 |
| 3,939,679 | 2/1976 | Barker et al. | 70/277 |
| 4,019,355 | 4/1977 | Germanton | 70/278 |

*Primary Examiner*—Rodney H. Bonck
*Attorney, Agent, or Firm*—Alfred E. Miller

[57] ABSTRACT

An electronic lock system senses codes on a key by means of opto-electronic, magnetic or other electrical means and compares the key code to a code stored internally in a memory. When the key code is equal to its respective stored code the lock activates an electrical clutch operated bolt, and may also change the internal code to a new code.

This invention relates to electronic locks, and is more particularly directed to the provision of an electronic lock which can be operated by a key having a code in the form of an electric parameter or optical parameter thereon.

5 Claims, 6 Drawing Figures

CODE FIELD COUNTER
TIMER COUNTER
ADDRESS COUNTER
COMPARATOR
M.S.
RESET 59
SYN
CLOCK
SYNC
RESET PULSE
Vcc
10K
Do
Di
A7
A6
A5
A0 A3

ELECTRONIC LOCK SYSTEM

This is a continuation of application Ser. No. 667,105, filed Apr. 16, 1976, and now abandoned.

BACKGROUND OF THE INVENTION

At present most of the locks available on the market are mechanical in nature and are susceptible to picking by criminals. One great disadvantage of the mechanical locks has been non-interchangeability of the code in the field.

Recently some electronic locks have appeared in the market which use solenoids or electrical motors to activate the bolt mechanism. Such systems usually have the disadvantage, however, of unreliable mechanical operation of the locks, thereby preventing their wide usage. These systems also have direct solenoid or motor operated bolts, so that they require relatively large power. This disadvantage has prohibited locks incorporating them from being designed as self contained battery operated units. The present invention is directed to the problem of an electronic lock which overcomes the electromechanical interface problems between the electronics and the mechanical elements of the lock.

Briefly stated, in accordance with its invention, the above object is attained by providing an electronic locking system including means for sensing a key code, by means of opto-electronic, magnetic or other electrical means. The key code as sensed is compared to an internally stored code in the lock system. Depending upon the results of comparison and control commands on the key, the bolt mechanism of the lock may be activated and/or the internally stored code in the lock system may be changed to a new code.

In the locking system of the invention an electromechanical interface is provided between the bolt of the lock and the electrical portion of the lock system, thereby permitting very reliable operation of the lock. The locking system may be operated with battery power, since the battery is required only to activate the clutch and not to activate the bolt mechanism. The locking system thereby does not rapidly drain the energy source, and may be operated over very long periods of time without replacement or recharging of the batteries. As a consequence, the lock system of the invention may be self contained and battery operated.

In a further feature of the invention, the lock key is operated only upon removal of the key from the lock. This arrangement eliminates the problems that occur when the operator forgets to remove the key from the lock. A key is thereby not available for use by unauthorized personnel.

In a still further feature of the invention, the locking system provides for multi-access level, such as master keys, floor keys, guest keys, and backup keys, and this feature may be effected in an inexpensive manner by employing a special control code of the keys directed to special portions of the memory of the locking system.

In a still further feature of the invention, the locking system incorporates a timer which switches power to power consuming circuits of a lock only during active operation of the lock. This feature, in addition to the above discussed clutch bolt mechanism, reduces the power consumption of the lock and thereby also facilitates operation of the lock by batteries.

In still further features of the invention, the lock system of the invention may be easily interfaced with an electronic alarm or security system and the code of the lock may be changed by special keys which do not permit access by way of the lock. The locking system of the invention is also adaptable for use with a key code to permit only a single entry by way of the lock, i.e. the code may be self-cancelling. The lock system of the invention may also be readily arranged under the control of a manual switch, to restrict lock operation to a selected number of access levels.

In order that the invention will be more clearly understood, it will now be disclosed in greater detail with reference to the accompany drawings, wherein.

DESCRIPTION OF THE PREFERRED EMBODIMENT

Figure 1:
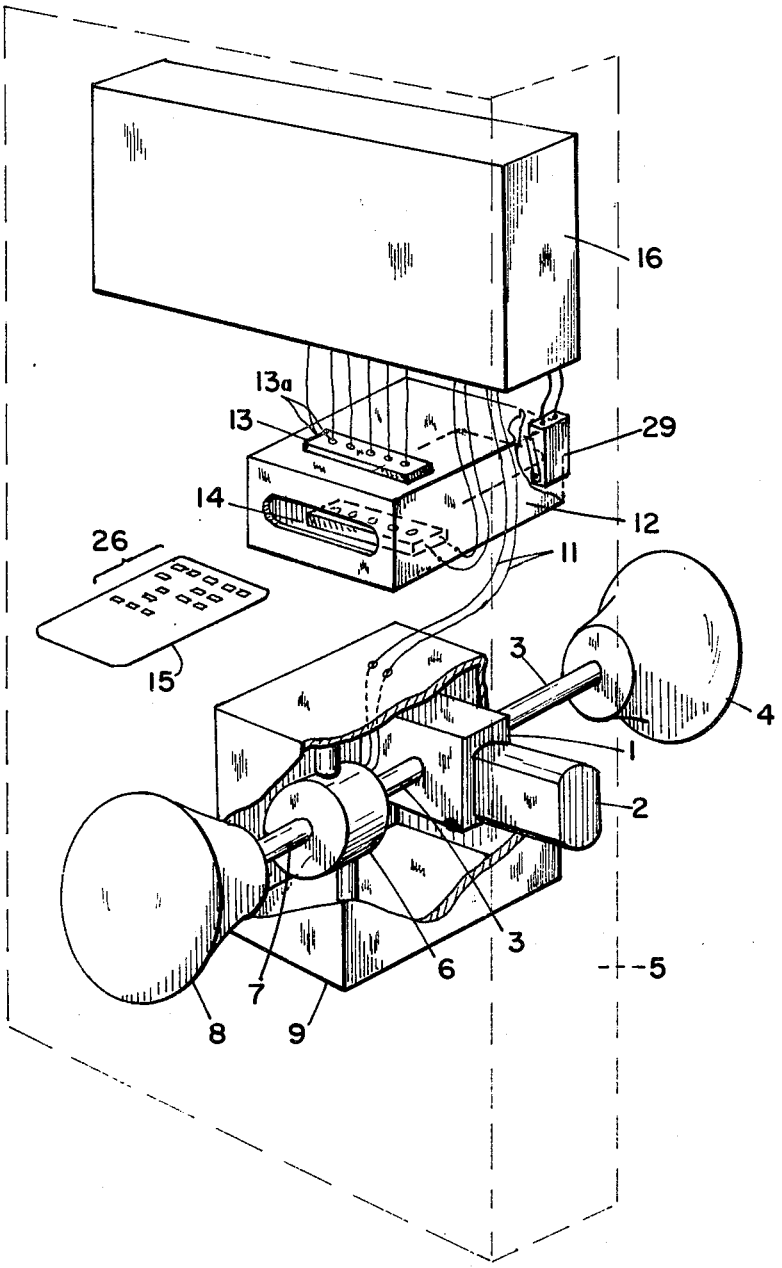
FIG. 1 is a perspective partially cross sectional view of a simplified form of a lock system in accordance with the invention.

Referring now to the drawings, and more in particular to FIG. 1, therein it is illustrated in simplified form an electronic lock in accordance with the invention. The lock as illustrated in FIG. 1, includes a conventional bolt mechanism 1 having a bolt 2. A shaft 3 extends through the bolt mechanism 1 in a conventional manner, and an inside knob 4 is directly affixed to the shaft 3 of the inside of door 5 in which the assembly is installed. The other end of the shaft 3 is coupled by way of a clutch 6 to a further shaft 7, and a knob 8 is affixed to the shaft 7 at the outside of a door 5. The clutch 6 is preferably an electrically operated clutch, as will be disclosed in greater detail in the following paragraphs. The bolt mechanism 1, clutch 6 and the associated shafts may be enclosed in a housing 9 for installation in the door 5 by conventional techniques.

The lock in accordance with the invention further includes a reader assembly 12 mounted in the door and having therein a code detector 13 at a slot 14 for receiving a key 15. The key 15 is provided with coded data, as will be explained in greater detail, and the code detector 13 includes means for sensing the form of the data on the key 15.

A switch 29 is provided at the rear of the slot 14, and adapted to be closed upon full insertion of the key 15 in the slot 14.

In addition, the lock includes a control circuit assembly 16 connected to the code detector 13 and the switch 29. Leads 11 connect the control circuit 16 to the clutch 6.

While the mechanical and electromechanical elements of the lock assembly have been illustrated in FIG. 1 as forming a separate element from the reader assembly and the control circuitry, it is apparent that the invention has been illustrated in FIG. 1 with such configuration in order to simplify its understanding and these elements may be combined to form a compact unit for ready assembly in the door 5.

The key 15 is provided with a code 26. The code 26 may be an optical code or a magnetic code or alternatively it may employ any other electrical variable or property such as resistance, capacitance, inductance, resonant frequency, or the like.

Figure 2:
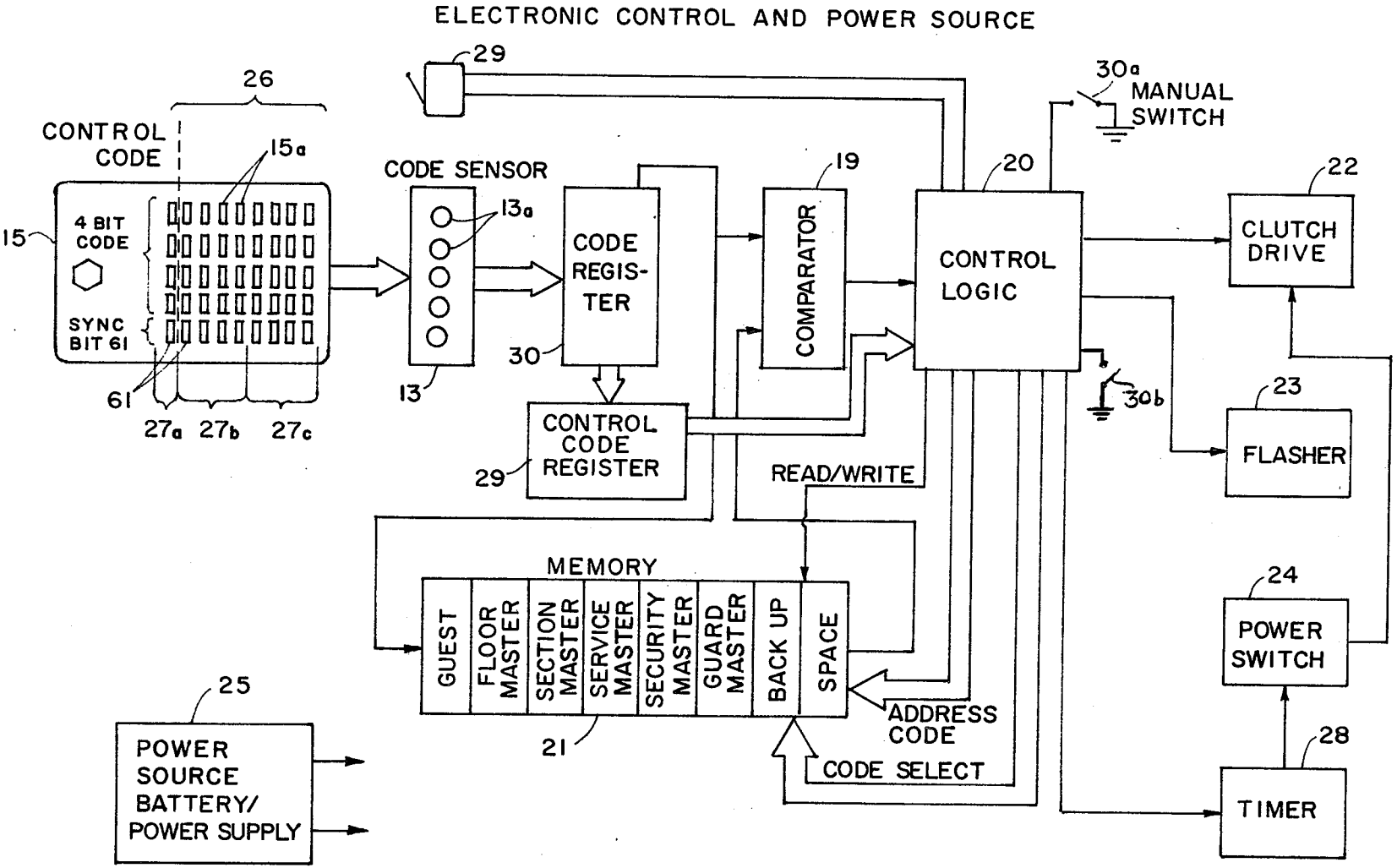
FIG. 2 is a block diagram of the electronic control portion of the lock of FIG. 1.

As illustrated more clearly in FIG. 2, the key 15 may be comprised of a card having thereon a plurality of rows and columns of marked code areas 15*a*. If the marked areas 15 form an optical code, then the code sensor may comprise a plurality of light sources and aligned light detectors for separately detecting the codes in each row. Alternatively, of course, other code sensing devices of conventional nature may be employed for sensing codes in the form of other electrical variables. The code sensors 13*a* are arranged to simultaneously read the markings of each column of the key, so that, as illustrated in FIG. 2, the codes of each column are applied in parallel to a code register 30 and the codes sensed in the different columns are sequentially applied to the code register 30.

The columns of the codes 26 on the key are separated into three regions. Thus, the first column 27*a* forms a control code. A group of columns 27*b* adjacent to the control column 27*a* form one key code and a second group of columns 27*c* form another key code.

In the embodiment of the invention illustrated in FIG. 2, each of the columns is shown as having four areas 15*a* for storing a four bit code and a fifth area 61 for storing a sync bit.

In order to simplify the explanation of the invention, a brief explanation of the operation thereof will now be given.

Keys of the type of key 15 may be employed by a number of different types of personnel. For example, if the lock of the invention is to be employed as a guest-room lock in a hotel, keys may be required for guests, as well as various service personnel, such as maids. The codes 27*a* in the first column of the key identified such personnel by "access level". The lock on the invention is arranged so that different personnel will be afforded different opportunities with respect to opening of the lock. For example, with respect to a guest, the code columns 27*b* may determine a code for initial opening of the lock and once the lock has been opened by this code, the code stored in the lock is changed to the code corresponding to the code columns 27*c*. This arrangement thereby permits the guest to enter the room for the first time by means of a code stored in the lock that was available to a previous guest, while further enabling changing of the code to a new code which will not permit entry by the previous occupant. No problem will thereby arise if the previous occupant has retained his key. The key 15 for a guest may be of course first coded to permit entry to only one guestroom.

Keys at other access levels also have changeable codes and permit, for example, certain personnel access to a number of guestrooms.

While the key 15 may be passively coded as discussed above employing an energy source in the lock for the sensing of the code, it is of course apparent that the key may be designed so that no energy source is required in the lock for searching the code. For example, a key may be magnetically coded with a sensor 13 comprising means for sensing the velocity dependent electromotive force of the key as the key is moved through the sensor. Alternatively, the key may be provided with its own energy source such as an RF transmitter, etc. It will be apparent that the invention is thereby not limited to the form of the key employed and is adaptable to different forms of coding.

The codes which correspond to different access levels such as master keys, guest keys, or any other designated keys, are, upon detection, initially stored in the memory 21, FIG. 2. The number of access levels can be expanded to any level in simple fashion as will be explained further. In a practical form, the lock embodies eight levels of access which may be designated as guest key, floor master, section master, security master, guard master, service master, backup key, spare, as shown in sectors of memory 21 (FIG. 2). The access levels are selected by the control code 27*a* on the key. The combination of a selected number of bits on the control code 27*a* gives the desired number access levels. In case of eight access levels, three bits are utilized which gives $2^3=8$ access levels. The control code 27*a* is also used for other auxiliary functions which shall be described further. The key code 26*b* is composed of an appropriate number of bits whose binary combination value approaches a desirable high number. For practical purposes the original form of the lock presented in the invention utilizes 32 bits for the combination 27*b*. This number can be changed as desired depending on the application of the lock. The 32 bit combination 27*b* FIG. 2 originally selected for the lock for descriptive purposes generates $2^{32}$ combinations, which is a relatively high number.

The initial storage of the internal codes in the memory 21 FIG. 2 is done in external fashion by manually setting the memory 21 to write mode by means of a switch 30*b* on the control logic circuit 20, and forcing the memory to store the codes received through the reader assembly 12. The memory is set into write mode for initial code storage by the switch 30*b* which can be accessed only by disassembly of the lock. Also some selected codes in memory 21 can be forced to change by setting the memory into write mode using an external switch which is enabled by another selected master key. Once the initial codes for each access level have been stored manually in memory 21 and switch 30*b* has been opened, the writing of the new codes in the memory 21 FIG. 2 is internally controlled. The lock then operates in automatic internally controlled mode as follows: when a key 15 is inserted into the reader assembly 12 no action takes place until the key is fully inserted and activates the microswitch 29. The activation of the microswitch 29 is sensed by the control logic 20 (FIG. 2) which then resets all pertinent logic circuits to a key read mode and simultaneously starts the timer circuit 28 (FIG. 2). The timer 28 (FIG. 2) is essentially a monostable circuit, which when activated by the control logic enables a power switch 24. The power switch 24 then applies power to the electrical sections of the lock that require heavy current, such as a light source bank in the code sensor if optical sensing is employed (FIG. 1), clutch drive 22 (FIG. 2) and flasher 23 (FIG. 2) These elements are powered until the timer 28 disables the power switch 24. It must be emphasized here that during quiescent state of the lock, the logic circuits that remain active such as the memory 21 and other necessary circuits, utilize very low power which is imperative for long battery life. Special low power logic families, such as CMOS or $I^2L$ are used in these continuously active logic sections. The utilization of the timer circuit 28 and power switch 24 is essential to the operation of the lock with batteries in an economically feasible manner otherwise heavy battery drain would require frequent battery changes with prohibitive expanse and inconvenience for the user. The timer circuit 28 stays active for an appropriate length of time during which the lock can be opened and the code changed if the key code 27b is the same as the stored code in the memory 21 (FIG. 2). Code comparison in comparator 19 follows activation of the timer 28. The key 15 is withdrawn from the reader assembly 12 during which time the code detector assembly 13 scans the key 15 in serial fashion. The code on the key is temporarily stored in the code register 30. The first field of the code is the control code 27a which is stored in the control code register 29. The primary function of the control code 27a is to select different access levels of the lock, such as guest keys, master keys, etc. A combination of any desired number of bits can be used to select different sections of the memory 21. Other auxiliary functions of the control code 27a will be discussed later. For a practical application of the lock, such as a hotel lock, the number of access levels can be eight levels. This is the number of access levels, which has been selected for explanation purposes of the present invention. The number of access levels can, of course, be very easily expanded to any desired number. The eight levels may be arbitrarily designated as guest key, floor master, section master, guard master, security master, service master, backup and spare, as shown on the memory 21 in FIG. 2. Eight levels are derived from the binary combination of three bits of the control code.

Following storage of the control code 27a in the register 29, each field of the key code 26 is temporarily stored in the code register 30, FIG. 2. A compare cycle is initiated by the control logic 20 following the storage of a field of code in the code register 30. During the compare cycle the memory is read and each bit of the stored field of the key code is compared with its corresponding field in the memory 21 FIG. 2. If any bit of the key code 26, FIG. 2, does not compare with its corresponding bit in the memory 21, FIG. 2, the uncompare condition is stored in a Compare Result register 41 (FIG. 3) which is a part of the Control Logic 20. The number of code bits on a key code field and the number of fields or columns in a code 26 are selected for an appropriate compromise between the combination and memory size which are both directly related to the number of bits present on the code 26. The preferred embodiment of the lock has one column for the control and four columns for each of the key codes 27b and 27c. Each column has four bits. A counter in the control logic 20 counts the number of fields on the code 26. FIG. 2, for control purposes by counting the synchronizing bits 61. At the end of code entry from the key 15 the counter in the control logic 20 activates decision logic which performs the functions of lock operation and code change when all conditions are met to perform these functions.

Lock operation function is achieved by enabling the clutch drive circuit 22 which in turn activates the clutch 6 (FIG. 1) and permits opening of the lock through the knob 8. The code change function is performed by switching the memory 21 to a write mode through the control logic 20. If a new code is then received by the reader assembly 12 it replaces the existing code in the memory 21 in the appropriate access level section as determined by the control code 27a, FIG. 2. The new code can be on the key 15 which has operated the lock, or on a separate key. It must be emphasized here that in this invention the recognition of a code 26 to be equal to a stored internal code in the memory 21 performs two major functions which are (1) enabling of the clutch 6, FIG. 1, to permit entry through usage of the lock, and (2) to permit changing of the stored code in the memory 21. The invention eliminates the need for multiple codes for performing these functions and consequently reduces storage of the codes to a minimum level.

Another feature of the present invention is the novel means of operating the bolt 2, FIG. 1, of the lock by utilization of an electromechanical clutch 6, FIG. 1. The clutch operated bolt 2 offers several advantages over existing methods of interfacing electronic locks with mechanical bolts. The clutch 6 is activated by the control logic 20 through the clutch drive circuit 22 when the code on the key 15 is the same as the corresponding code in the memory 21, and other control conditions do not inhibit opening of the lock. The clutch 6 can be of any commercial electromechanical type utilizing solenoids or other forms of magnetic or electrostatic power conversion elements, which transmit power from one shaft 7, FIG. 1, to the other 3. The activation of the clutch 7 permits transmission of torque from the knob 8 to the shaft 3, FIG. 1. When this torque transmission is enabled by the clutch, the operator of the lock can then turn the knob 8 to activate the bolt mechanism 1 through the coupling of the shaft 7, FIG. 1, clutch 6, and shaft 3. The bolt mechanism 1 can be of any commercial type which translates torque from a shaft 3 to linear motion, which in turn drives the bolt 2, FIG. 1. The electromechanical clutch 6 provides several advantages over existing electronic or electrical locks which can be summarized as: (1) operation of the lock with mechanical power amplification utilizing operator muscle power as a power source; (2) high reliability of operation due to the power amplification; and (3) elimination of forceful operation of the bolt due to separation of the knob 8 from the internal elements of the lock when the clutch 6 is not activated. The inside knob 4 is directly connected to the bolt mechanism 1 and permits manual operation of the lock from inside of the door 5 or any other fixture on which the lock is mounted.

The clutch mechanism 6 can be located at different sections of the lock including the interior of the knob 8, FIG. 1.

As stated above the lock of the invention performs several auxiliary functions in addition to major functions of operating a bolt mechanism for entry and changing of internally stored codes when commanded. The auxiliary functions are covered in detail in the following paragraphs.

One bit of the control code 27a is utilized to perform the function of inhibiting the lock operation of entry while permitting the change of code. This feature permits changing of any stored code in the memory 21 without gaining access through the lock. Keys which have the inhibit bit present can be used to change codes rapidly throughout a building without access through the locks. This function is highly desirable when unproven personnel is utilized to change codes in locks located at institutions such as hotels, motels, schools, military installations, etc.

Another feature of the control code 27a is to enable a special type of key which can be used to open the lock only once. The single usage key is highly desirable when thefts or other criminal activities take place due to distribution of keys from authorized personnel to criminals. The single usage key function is achieved by decoding the type of key from the control code 27*a* and permitting opening of the lock only when the code is changed to a new one. The condition that the key code is the same as the internally stored code is not sufficient to open the door for this mode.

An additional feature of the lock is the double lock function where a manual switch 30*a* limits access through the door to a selected number of types of keys when activated. This function is realized by decoding the appropriate types of key through the control code and limiting access through the door by inhibiting the clutch drive circuit when the switch 30 is activated. The electronic double lock feature enhances the security level of the invention by providing additional control over types of keys to be used for entry.

The previous description of the functions of the lock and the means of achieving them covered all major parts of the lock. The electronic section of the lock as shown in FIG. 2 is composed of the code detector 13, code register 30, control code register 29, comparator 19, control logic 20, memory 21, clutch drive 22, flasher 23, power switch 24, timer 28, microswitch 29, manual switch 30*a*, power source 25. The electronic circuits which constitute the elements given above can be realized in practice by a number of logic design approaches using random logic or micro-processor oriented control circuits. It should be emphasized here that the novel aspects of the lock are covered by utilization of the major elements given in FIG. 1 and FIG. 2. The details of these elements can be slightly varied using different design approaches but detail differences in logic design does not alter the basic relationships that exist between these elements which render it superior and economically feasible over previous types of electronic locks. The following paragraphs cover two alternate logic designs which constitute the same major elements and performs their related functions. The first arrangement uses random logic design and is presented in FIG. 3. The second arrangement uses a more recent development in electronics, i.e. a micro-processor, and its peripheral elements to perform the same functions. The random logic design will be discussed first in the following paragraphs.

The code dector 13 is comprised of photo detectors 32–35. The output of the photo detectors is applied directly to the registers 36–39 respectively which form the code register 30 of FIG. 2. The electronic circuits operate in the following detailed sequence during operation of the lock: when the key 15 is inserted fully into the reader assembly 12 it activates the microswitch 29. The microswitch 29 is turn activates the mono-stable circuit 49 which generates a reset pulse 59. The reset pulse resets all pertinent circuits of the electronic control sections of the lock shown in FIG. 3.

When the timer counter 53 is reset its output becomes logic zero and is inverted by the inverter 55. The inverter's output becomes logic 1 and turns on the power switch 24. The power switch in turn activates the clock 54 and the counter 53 starts a countdown for the active time interval during which the lock operates and changes the code when the key 15 has the correct code.

Figure 3:
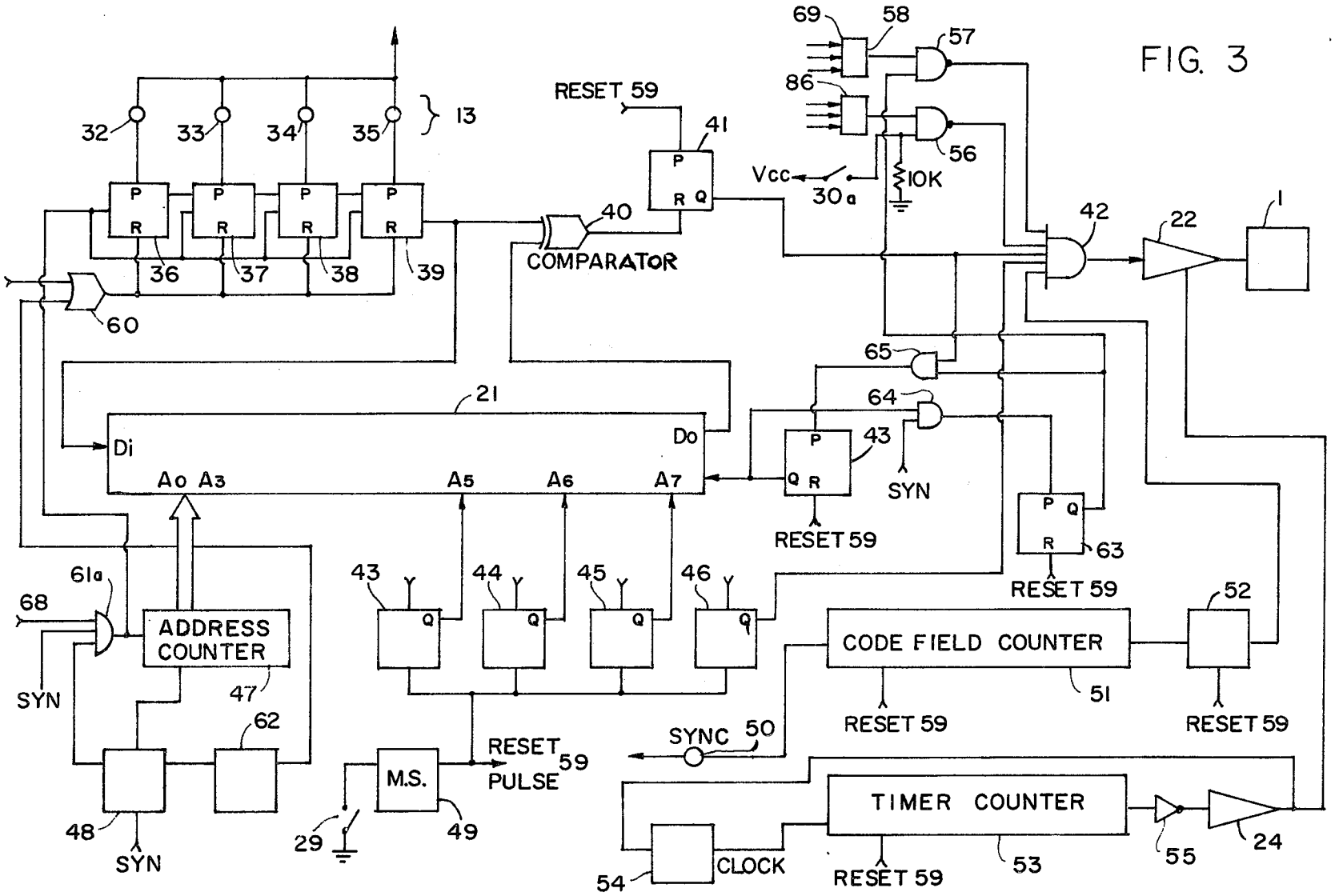
FIG. 3 is a circuit diagram of one embodiment of the circuit of FIG. 2.

The key verification and related operations of the lock follow the activation of the lock logic by the reset pulse in the following manner: after the timer and power switch 24 are energized due to operation of the microswitch 29 the light sources of the code sensor, which may be light emitting diodes, are turned on by the power switch 24. The reader assembly 12 then scans the key 15 as it is being removed from the reader. The code sensor assembly 13 receives light through code holes on the key 15. The code is received in serial fashion with a field of parallel bits aligned with the light source 14 and code detector assembly 13. Each field is temporarily stored in the code register 30 (FIG. 2) which is composed of registers 36–39 of FIG. 3. The first field of the code is the control code 27*a* and it is stored in the control code register 29 of FIG. 2 which corresponds to registers 43–46 of FIG. 3. The control code's first three bits are used to select eight access levels stored in the memory 21. The memory 21 is a standard solid state register which includes its own binary address decoding logic. It must be emphasized here that there are several types of commercial electronic memories which can be utilized in this invention. The basic criteria for their usage is low power consumption and low cost, and simply addressing logic. One bit of the control code 27*a* stored in register 46 of FIG. 3 is used to perform the function of inhibiting the opening of the lock while permitting changing of the code. On a guest key this bit is a logic 1 and permits the AND gate 42 to enable the clutch driver circuit 22 if the code on the key 15 is correct. On a code change only the inhibit bit on the key is a logic zero and is stored in register 46 which in turn disables the clutch driver circuit 22 through the AND gate 42 at the same time permitting code change operation. The key code 27*b* is compared to the stored code in the memory 21 in the following manner: following the storage of the control code 27*a* in the control registers 43–46, each column of the key code 27*b* is initially stored in the code registers 36–39. The synchronizing bit 61 is utilized to store the bits of a column of the key code 27*b* and clear the registers 36–37 following a comparison cycle for a column of the codes. The registers 36–39 are initially cleared by the reset pulse which progresses through the OR gate 61*a*. The logic 1 bits of the fields of the key code 27*b* set their corresponding registers through photo detectors 32–35. The trailing edge of the sync pulse 61 detected by the sync detector 50 clocks the flip flop 48 which enables application of the clock signal 68 in the address counter 47 by way of OR gate 61*a*. The address counter addresses the stored bit in the memory 21 which corresponds to the code bit stored in the code registers 36–39. The corresponding code bits on the key 15 and the memory 21 are compared by the EXCLUSIVE OR gate 40. When the two bits are not equal the output of the EXCLUSIVE OR gate 40 resets the compare flip flop 41 which has been initially preset by reset pulse 59. Each clock pulse gated by the AND gate 61*a* advances the address counter and shifts and stored code field bits in registers 36–39. Each bit of the code, key code and the stored code are compared serially in this fashion. The shifting and address incrementing operations for each field of code take place as many times as the number of bits present in a column of the code 26. The number of bits shifted and increments of the address are monitored by the flip flop 48 which is reset by the appropriate output of the address counter 47 which corresponds to the number of bits in a field of the key code 26.

When the flip flop 48 is reset it triggers the mono-stable circuit 62, which in turn generates a reset pulse that passes through OR gate 60 and clears the code registers 36–39. At this time the code registers 36–39 are ready to receive another field or column of the code on the key. The number of fields on the key 15 which are scanned by the reader assembly 12 are counted by incrementing the field counter 51 by the sync pulse detected from the sync detector 50. When the number of fields from the key 15 is equal to the number of stored fields in the memory 21 the field counter 51 clocks end of cycle flip flop 52 which has been reset initially by the reset pulse 59. When flip flop 59 is set to logic 1 the control logic is ready to perform the major lock functions, namely, to operate the lock and change the code if a new code is present on the same key or another key.

When the compare flip flop 41 stays in logic 1 condition throughout the comparison of all the bits of an access level stored in the memory 21 and key code 26, FIG. 2, it is logically determined that the code on the key is a valid code. At the end of a valid compare cycle, the flip flops 41,52 are both at logic level 1. At this time, the AND gate 42 is enabled, provided all the other inputs which correspond to other auxiliary functions are also logic 1. The output of the AND gate 42 then activates clutch driver circuit 22 which has been powered initially by the power stitch 24. The clutch driver 22 in turn activates the clutch mechanism 6 which then enables operation of the lock by turning a knob 8.

The validation of the code which corresponds to flip flops 41 and 52 as concurrently logical 1 enables the second major function, i.e., change of code, in the following manner: the AND gate 64 is enabled by the outputs of flip flops 41 and 52 resets the write flip flop 43 which has been initially reset by the reset pulse 59. When the write flip flop 43 is set to logic 1 the memory 21 is set to receive a new code through the reader until the timer shuts off the active cycle. A new code can be on a separate key or the same key which operated the lock depending on the size of key to be used and convenience of the user.

When a new code is entered through the reader assembly 12 following validation of the original code, it repeats the compare cycle in the same manner as the original code with the difference only that the memory 21 is set into write mode by the write flip flop 43. Each bit present at the input of the EXCLUSIVE OR gate 40 is also the input bit to the memory 21 and is written in the appropriate memory cell during a write cycle for a new code. The compare function is still performed during a write operation, but is redundant.

Two other auxiliary functions are performed by the electronic logic circuits which permit the lock to be operated under restricted conditions. These functions are the single key operation and electronic double lock feature. The single key operation function is performed by enabling operation of the lock only during a code change which happens when a key has a new code to replace the existing one in the memory 21. The access types which are to function in this mode are decoded by the decoder 69 which has as its inputs the outputs of registers 43, 44, 45. The output of the decoder 69 becomes a logic 1 for any selected access level which is to operate in the single operation key mode.

The output of the decoder 69 is one of the two inputs of the NAND gate 57. The second input is from flip flop 63 which is set to logical 0 only when a write operation takes place through the AND gate 64. The AND gate 64 is enabled only when the write flip flop 43, FIG. 3, is set and a sync pulse is detected by the sync detector 50. Therefore, when a write operation takes place for an access level used in the single operation mode, the output of the flip flop 63 is logical 0 and the output of the decoder 69, FIG. 3, is logical 1, which makes the output of the NAND gate 57 a logical 1 and permits the lock to operate. When no write action takes place for the same access level, the output of the flip flop 63 stays as logical 1 and the decoder 69 is also logical 1 which, in turn, makes the output of the NAND gate 57 logical 0. This inhibits the gate 42 and in turn disables operation of the lock. Therefore, the lock operates only once during the write operation of a new code from a key which makes it a single operation key for the particular access level selected by the decoder 69.

The double lock function is mainly performed by a decoder 86 which selects particular access levels which are inhibited from operating the lock when the manual switch 30 is activated. When a particular access level has been selected to be inhibited by the manual switch 30 it is decoded by the decoder 86 and the decoder's output becomes a logic 1 during operation of the lock. When a guest adtivates the switch 30 to restrict access to his room to only a selected number of access levels, the output of the switch circuit also becomes a logic 1. Therefore, the two inputs to the NAND gate 56 become logical 1 and the output of this gate becomes a logical 0 to inhibit the operation of the lock through the AND gate 42. The function of restricted entry is thereby realized.

Figure 4:
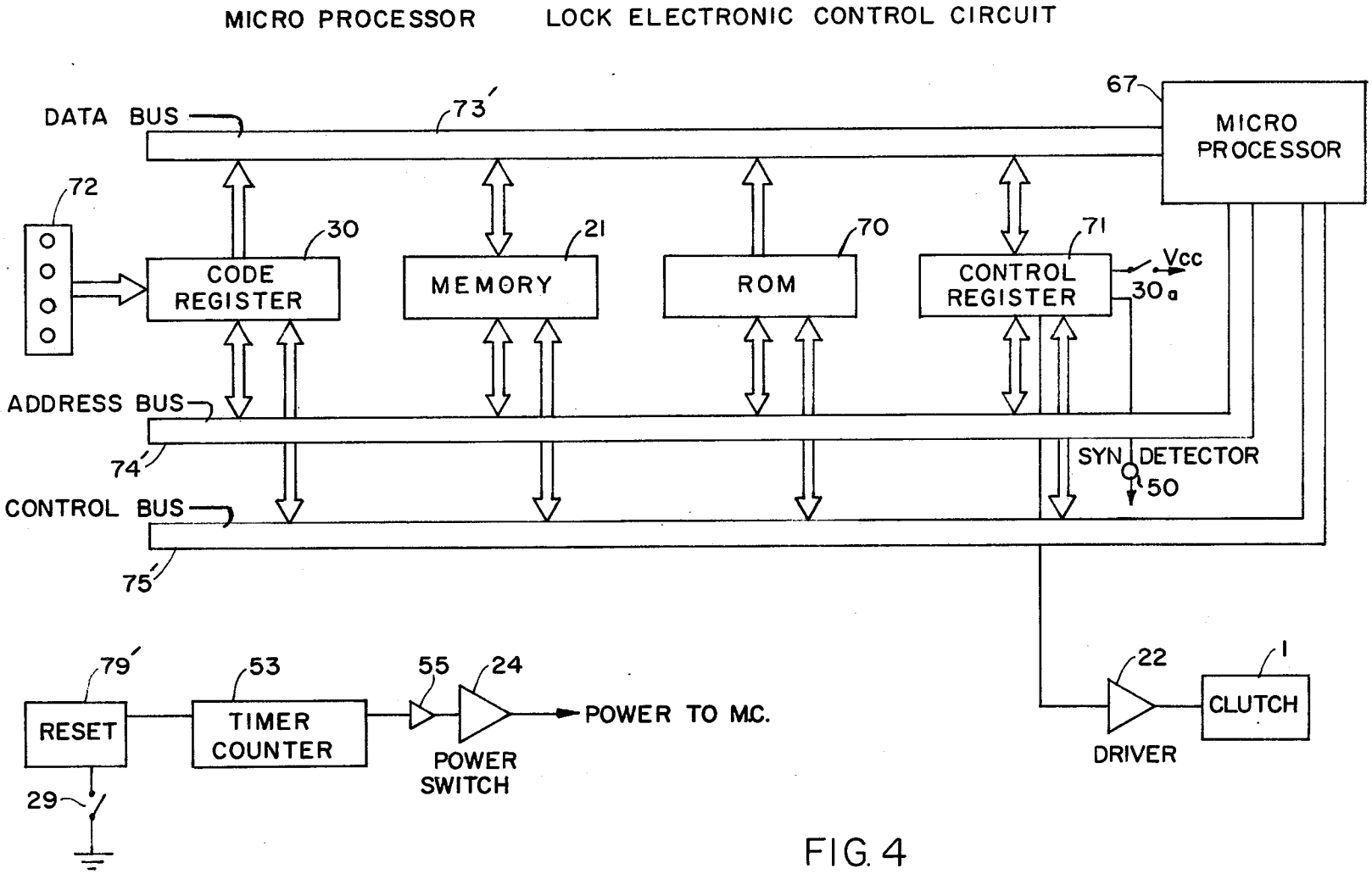
FIG. 4 is a block diagram of an alternate version of the circuit of FIG. 2, and employing a microprocessor.

In the arrangement of FIG. 4, employing a microprocessor, almost all of the control functions performed by the control logic 20 of FIG. 2 are performed by the micro-processor 67. The micro-processor 67 communicates with the other elements of the control section through the data bus 73', address but 74', and the control bus 75'.

The control program is stored in a Read-only Memory 70. The micro-processor 67 performs all the decision logic functions via the programs stored in the Read-only Memory 70. In some cases it may be desirable to have a changeable control program. This may be done by replacing the Read-only Memory 70 by a Random Access Memory whose contacts can be changed if desired. The sequence of operations to be performed by the micro-processor electronic control is shown by the flow diagram 74–84 in FIG. 5.

Initially the lock is in quiescent state with all power consuming sections turned off by the power switch 24. When the key 15 is inserted into the reader 12 it activates microswitch 29. This is the first step 74 of the flow diagram. The next step in the flow diagram is timer enable 75. When this step takes place the micro-processor 67, clutch drivers 22, and other power consuming sections of the lock are energized by the power switch 24. The next step in the flow diagram is step 76, where the code on the key 15 is received under program control of the micro-processor 67 and ROM 70. In the next step 77, control code 27 is processed by the micro-processor 67 and the type of access level is decoded. Following the access level section, the key code 26 is compared with the stored code in the memory 21 as shown in step 78. At this point a decision is made by the software which is based upon the key code being equal to its corresponding stored code in the memory 21. If the key code is not equal to stored code in the memory 21, the software enters into a "no operation" mode and no action takes place until timer 53 cuts off the power to appropriate sections of the logic in step 84. At this point, the lock enters into the quiescent state. If the key code is equal to its corresponding code in the memory 21, the software proceeds to perform the required functions from decision step 78. In the next step 79, the existence of a new code is checked to replace the existing code in the memory. If a new code is present, the stored code in the memory 21 is replaced by it in step 80. In either case, the software proceeds to step 81 which performs the special functions required by the control code 27*a* or switches such as 30*a,b* etc. Following this step the control functions are checked for lock inhibit function in step 82 and if there is no inhibit condition then the lock is operated in step 83. If there is an inhibit condition, the software enters into the "no operation" mode, and the lock returns to quiescent state at end of timer count in step 84.

Figure 5:
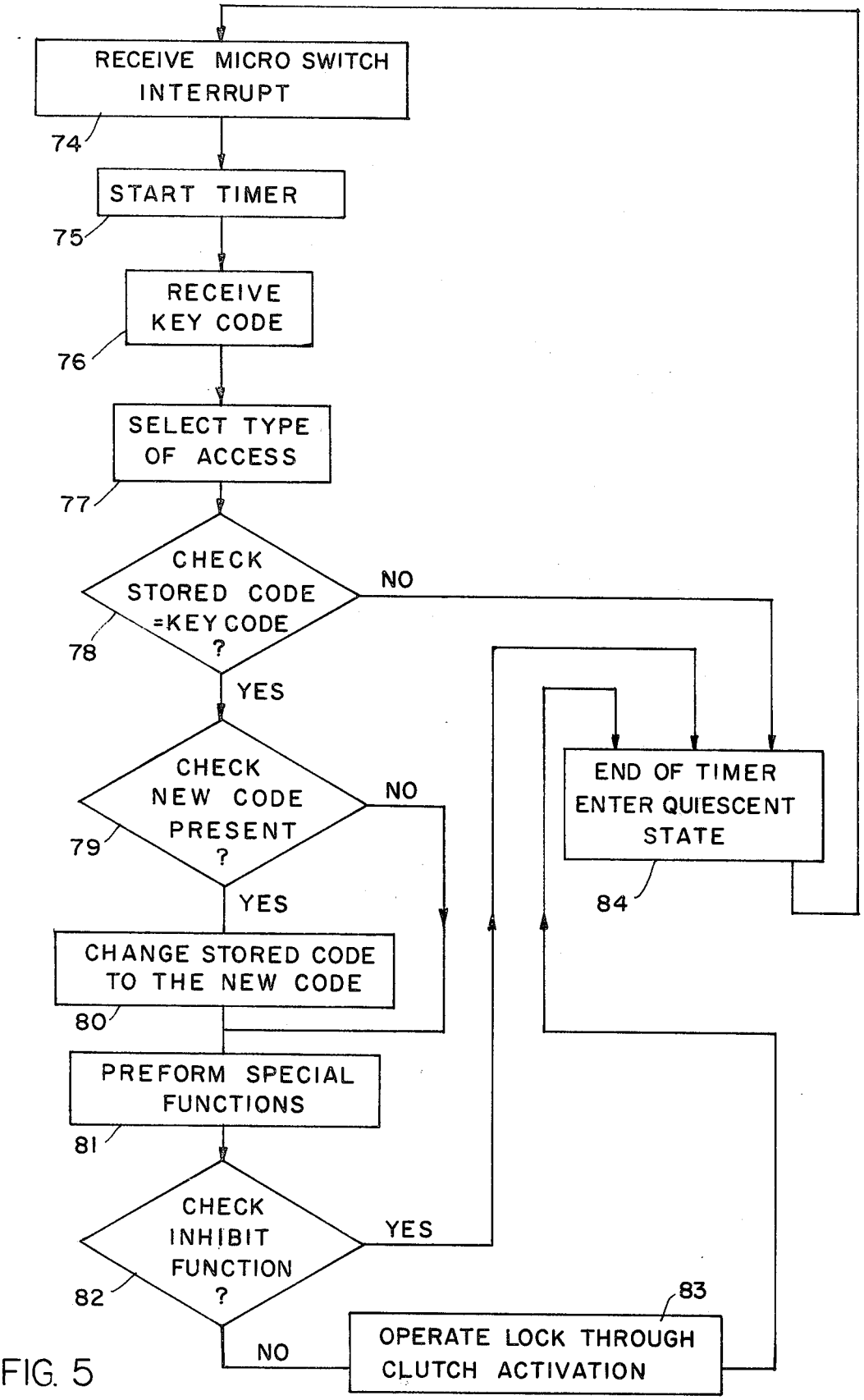
FIG. 5 is a flow diagram illustrating the operation of the circuit of FIG. 4.
Figure 6:
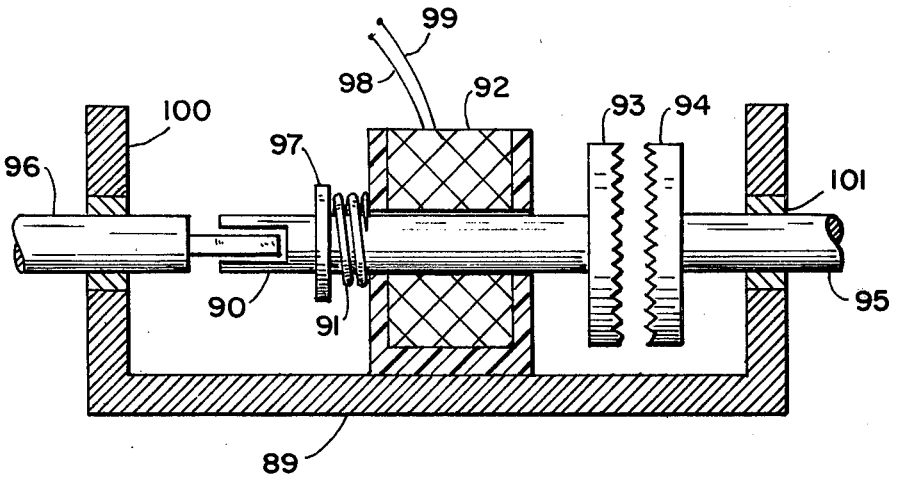
FIG. 6 is a partially cross sectional view of a form of clutch mechanism which may be employed in the lock system of FIG. 1.

FIG. 6 shows an example of clutch mechanism which can be used for the basic clutch shown in FIG. 2. The mechanism is supported by a suitable base 89 which supports an electromagnetic coil 92 and bearings 100, 101 for shaft 95 and 96. When the clutch coil 92 is not energized through the wires 98 and 99, the spring bias 91 keeps the shaft 90 and its connected gear teeth clutch 93 at a distance from the geared teeth clutch 94. Since there is a gap between the two gear faced clutch elements 93, 94 during non-energized state no torque can be transmitted from the shaft 96 to the shaft 95. When the coil 92 is energized through wires 98 and 99 for opening of the lock, the two gear faced clutch elements 93, 94 are engaged due to the electromagnetic force which pulls the electromagnetic shaft 90 into the coil 92 overcoming the spring bias 91. When the clutch elements 93 and 94, FIG. 5, are coupled, torque can be transmitted from shaft 96 to the shaft 95, which permits entry through lock by opening the bolt mechanism, FIG. 1, through the knob 8. Within the arrangement of FIG. 6, the outside knob on the door is thereby affixed to the shaft 96, and the shaft 95 is connected to the bolt mechanism as illustrated in FIG. 1. While the invention has been disclosed and described with reference to a limited number of embodiments, it will be apparent that variations and modifications may be made therein, and it is intended in the following claims to cover each such variation and modification as falls within the true scope and spirit of the invention.

What is claimed is:

1. A locking system comprising a key having first and second coded data thereon, a lock having a bolt operating mechanism, a memory, means for sensing data on said key, means responsive to sensed first data that corresponds to data stored in said memory connected to operate said bolt operating mechanism, and means responsive to sensed second data for changing the data in said memory to correspond to said second data, said lock comprising a slot for receiving said key, and switch means responsive to full insertion of said key in said slot and coupled to enable said sensing means, said sensing means sensing coded data on said key as said key is withdrawn from said slot.

2. The locking system of claim 1 wherein said key comprises a card having optical data thereon.

3. The locking system of claim 1 wherein said key has data stored thereon adapted to be electrically sensed.

4. In a lock having means of sensing coded data on a key, a bolt operating means, a memory, and means responsive to the receipt of sensed data that corresponds to data stored in said memory for operating said bolt operating means, the improvement wherein said lock further comprises means responsive to sensed data following the receipt of data corresponding to data stored in said memory for changing the data stored in said memory to data corresponding to said last received data, and further comprising an aperture for receiving a key, and switch means coupled to enable said sensing means in response to full insertion of a coded key in said aperture, said coded data being sensed on said key as said key is withdrawn from said slot means.

5. A lock circuit responsive to the receipt of coded data from a key for operating a bolt mechanism, comprising a row of sensing devices for sensing coded data on a key and providing parallel coded signals corresponding thereto, a memory having a plurality of storage locations each having an address, means responsive to first received coded signals from said sensing means for addressing said storage locations, means responsive to second coded signals from said sensing means for comparing said second received coded signals with coded data stored at the respective storage location, and means responsive to a comparison between said second received coded signals and the data stored in the corresponding storage location for actuating said bolt mechanism, said lock having an aperture adapted to receive a key, said lock circuit further comprising switch means responsive to full insertion of a key in said aperture and connected to enable said sensing devices, said parallel coded signals being sequentially produced as the key is withdrawn from said aperture.

* * * * *